US006752840B1

(12) United States Patent
Onishi et al.

(10) Patent No.: US 6,752,840 B1
(45) Date of Patent: Jun. 22, 2004

(54) DENIM-LIKE ARTICLE OF CLOTHING AND METHOD OF PRODUCING THE SAME

(75) Inventors: Takashi Onishi, Shiga (JP); Keiji Okamoto, Shiga (JP); Yoshinobu Hirano, Osaka (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 10/019,769

(22) PCT Filed: Feb. 25, 2000

(86) PCT No.: PCT/JP00/01102

§ 371 (c)(1),
(2), (4) Date: Oct. 19, 2001

(87) PCT Pub. No.: WO01/63035

PCT Pub. Date: Aug. 30, 2001

(51) Int. Cl.[7] ..... D06Q 1/02; D06C 11/00; D06C 27/00

(52) U.S. Cl. ..... 8/529; 8/531; 8/539; 8/114.6; 8/922; 8/924; 442/189; 442/200; 442/371

(58) Field of Search ..... 8/114.6, 922, 529, 8/531, 539; 442/189, 200, 311

(56) References Cited

U.S. PATENT DOCUMENTS 4,367,070 A * 1/1983 Hayashi et al.
4,519,804 A * 5/1985 Kato et al.
4,525,169 A * 6/1985 Higuchi et al.
5,870,807 A * 2/1999 Beaty et al.

* cited by examiner

*Primary Examiner*—Margaret Einsmann
(74) *Attorney, Agent, or Firm*—Piper Rudnick LLP

(57) ABSTRACT

The present invention relates to a denim-like clothing mainly including a woven or knitted fabric and having a whitening index of less than or equal to Class 4, which woven or knitted fabric includes ultrafine fibers or fibers capable of forming ultrafine fibers on its surface, and the whitening index is expressed in grey scale for assessing change in color specified in Japanese Industrial Standards (JIS). In preferred embodiments, the denim-like clothing has, for example, the following characteristics:

(a) The denim-like clothing has a roughness index of equal to or more than 3 micrometers as determined using a measuring machine, KES-FB4;

(b) the ultrafine fibers or the fibers capable of forming ultrafine fibers are ultrafine fibers having a fineness of less than or equal to 0.6 dtex or fibers capable of forming ultrafine fibers having a fineness of less than or equal to 0.6 dtex;

(c) the fibers capable of forming ultrafine fibers are multicore fibers; and (d) the fibers have a matrix component that has been degraded.

The invented denim-like clothing includes the ultrafine fibers or fibers capable of forming ultrafine fibers on its surface and is easily whitened by flexing or rubbing to thereby exhibit the feeling or semblance of a natural fiber denim.

20 Claims, 4 Drawing Sheets

*Non-whitened portion*

*Whitened portion*

Whitened portion

Non-whitened portion

DENIM-LIKE ARTICLE OF CLOTHING AND METHOD OF PRODUCING THE SAME

TECHNICAL FIELD

The present invention relates to a method of producing a clothing like a natural fiber denim or a denim-like clothing with worn-out feeling.

BACKGROUND ART

In some conventional denim-like cloths and sewn fabrics, part of the clothes or fabrics such as a projection is whitened due to repeated washing or wearing. However, these denim-like cloths and sewn fabrics mainly comprise natural fibers, are heavy, are easily ripped and are significantly discolored by action of washing.

In contrast, polyester fibers, for example, are lightweight, are resistant to ripping and are colorfast against washing. However, no proposal has been made on cloths or sewn fabrics that are fully composed of synthetic fibers and exhibit the feeling of a natural fiber denim and on sewn fabrics like a natural fiber denim.

After intensive investigations under these circumstances, the present inventors found that, when a clothing composed of a cloth comprising fibers capable of forming ultrafine fibers is subjected to flexing or rubbing to thereby induce whitening of projections of the cloth, the resulting cloth becomes like a natural fiber denim. The present invention has been accomplished based on these findings.

Separately, Japanese Examined Patent Application Publication No. 59-53945, Japanese Unexamined Patent Application Publications No. 56-148963, No. 57-143567 and No. 59-130361 propose techniques, in which a polyester fiber cloth having a multicore structure is treated with an alkali and is converted into ultrafine fibers to thereby exhibit soft feeling. In these techniques, the polyester matrix component is pretreated with an acid, and the treated polyester matrix component can be readily removed by the alkali-treatment. In other words, the publications each propose techniques to enhance the conversion of the multicore fiber into ultrafine fibers. However, these acid treatments are performed as a pretreatment operations prior to the alkali-treatment and are not concerned with a technical idea for the production of a denim-like clothing.

Accordingly, an object of the present invention is to provide a clothing like a natural fiber denim, which comprises synthetic fibers as materials but exhibits the feeling or semblance of a natural fiber denim. In addition to the above feature, this clothing has inherent advantages of a cloth made of synthetic fibers. Specifically, the clothing is lightweight, is resistant to ripping and is colorfast against washing.

Another object of the present invention is to provide a method of producing a denim-like clothing from synthetic fibers fully utilizing the characteristics of conjugated fibers. The resulting denim-like clothing exhibits the feeling or semblance of a natural fiber denim or of a stonewashed fabric.

DISCLOSURE OF INVENTION

To achieve the above objects, the present invention employs the following means.

Specifically, the present invention provides a denim-like clothing mainly including a woven or knitted fabric and having a whitening index of less than or equal to Class 4.

The woven or knitted fabric comprises ultrafine fibers or fibers capable of forming ultrafine fibers on its surface, and the whitening index is expressed in a grey scale for assessing change in color specified in Japanese Industrial Standards (JIS). In preferred embodiments, the denim-like clothing has the following characteristics:

(a) the denim-like clothing has a roughness index of equal to or more than 3 micrometers as determined using a measuring machine, KES-FB4;

(b) the woven or knitted fabric is one selected from woven or knitted fabrics of modified structures, such as voile, mat USU (mat worsted), jacquard, corduroy, amunzen, cord and pile stitch;

(c) the woven or knitted fabric is produced by sewing a woven or knitted fabric having no roughness on its surface, such as taffeta, poplin, grey sheeting or SMOOTHNESS (interlock fabric) to thereby yield a sewn fabric exhibiting rough feeling on its surface;

(d) the ultrafine fibers or the fibers capable of forming ultrafine fibers are ultrafine fibers having a fineness of less than or equal to 0.6 dtex or fibers capable of in forming ultrafine fibers having a fineness of less than or equal to 0.6 dtex;

(e) the fibers capable of forming ultrafine fibers are multicore fibers;

(f) the fibers comprise, as a matrix component, a polyester containing from 1.5% to 15% by mole of a —$SO_3M$ group, where M is a hydrogen atom, an alkaline metal or an alkaline-earth metal;

(g) the matrix component has been treated with an acid;

(h) the multicore fibers each comprise different components, and the different components act as a matrix component with respect to each other and can be separated from each other; or (i) the denim-like clothing readily exhibits worn-out feeling by flexing or rubbing.

The denim-like clothing is sewn by a conventional technique, and at least part of the resulting sewn fabric is whitened and exhibits the feeling or semblance of a natural fiber denim.

The denim-like clothing is preferably produced, for example, by a method in which a woven or knitted fabric including ultrafine fibers or fibers capable of forming ultrafine fibers on its surface is treated with an acidic solution with pH of from 1.5 to 4 at temperatures from 100° C. to 140° C., and the treated woven or knitted fabric is subjected to a combination of a flexing or rubbing step and a colored step.

The above-produced denim-like clothing is whitened due to the ultrafine fibers or the fibers capable of forming ultrafine fibers on its surface and exhibits the feeling or semblance of a natural fiber denim.

BEST MODE

Figure 1:
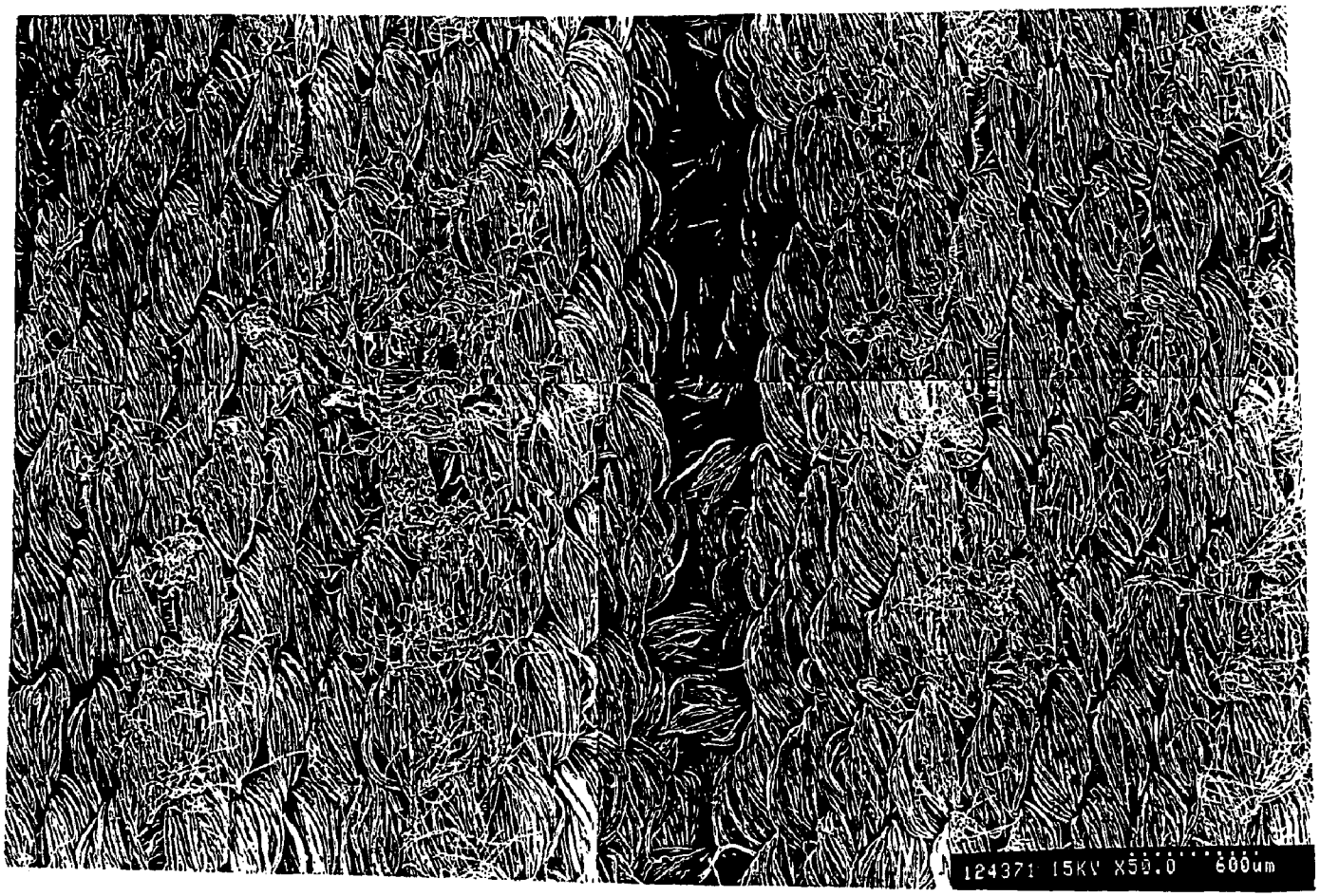
FIG. 1 is a photograph showing a non-whitened portion and whitened portions on a surface of a corduroy woven fabric according to Example 3.
Figure 2:
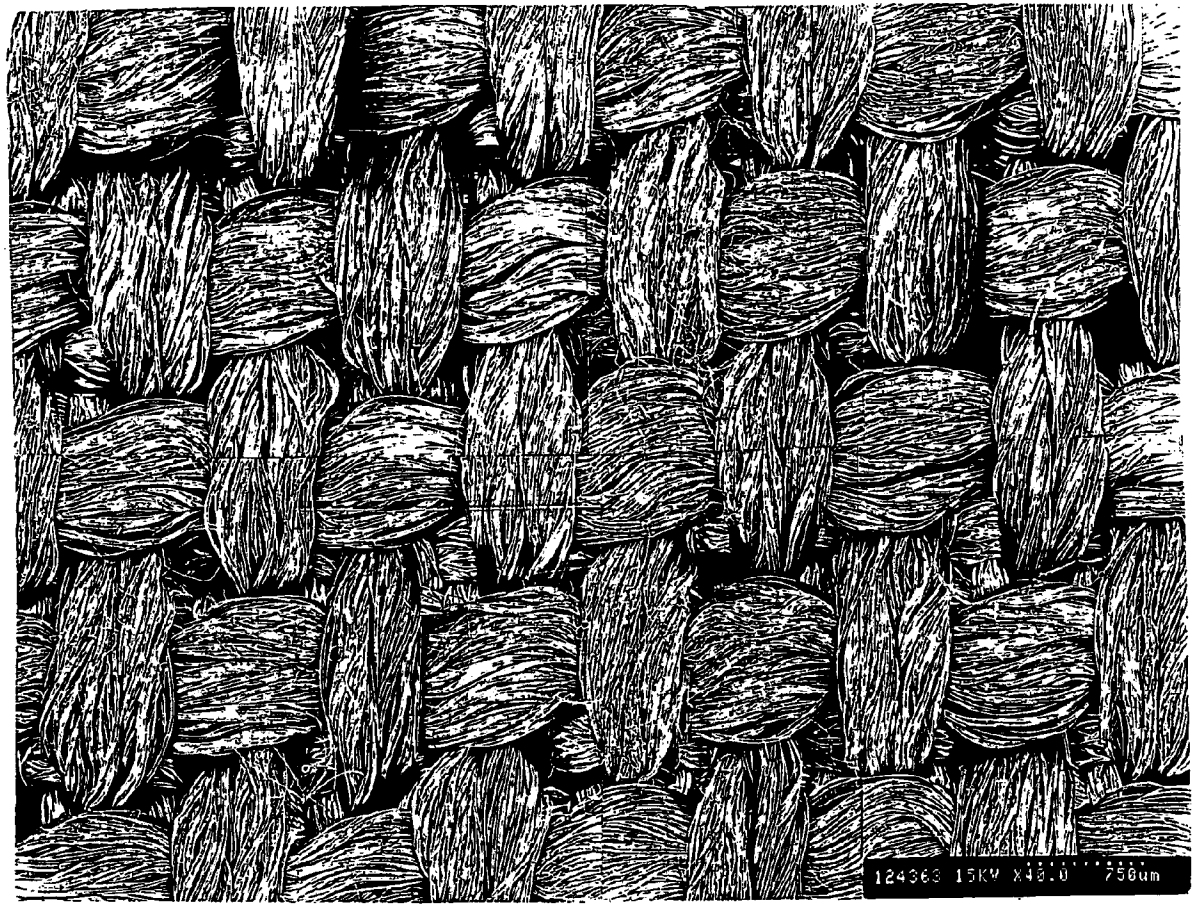
FIG. 2 is a photograph showing a non-whitened portion and whitened portions on a surface of a mat weave according to Example 4.
Figure 3:
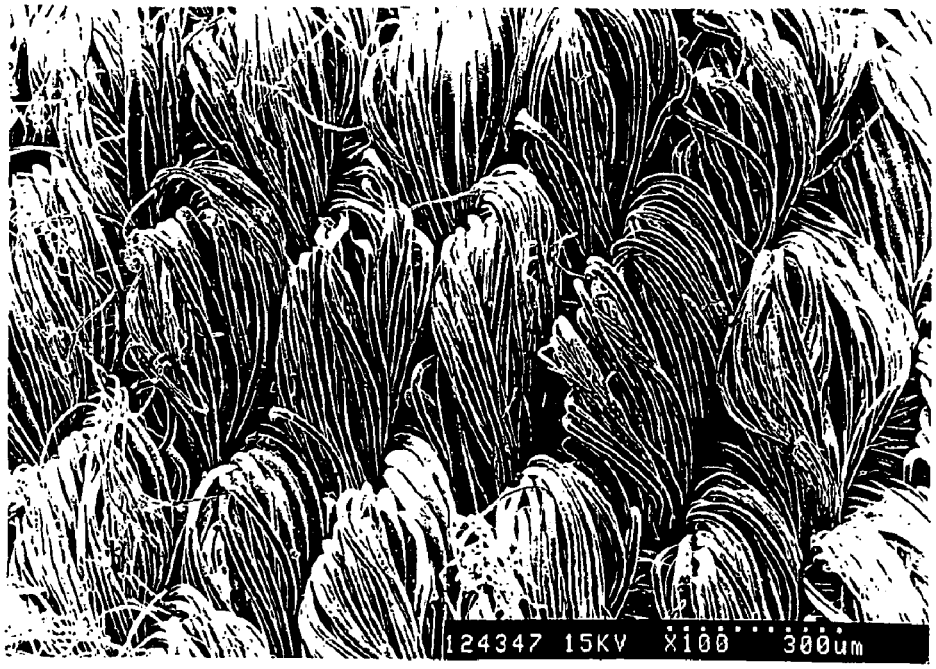
FIG. 3 is a partially enlarged perspective photograph showing the corduroy woven fabric according to Example 3.
Figure 3:
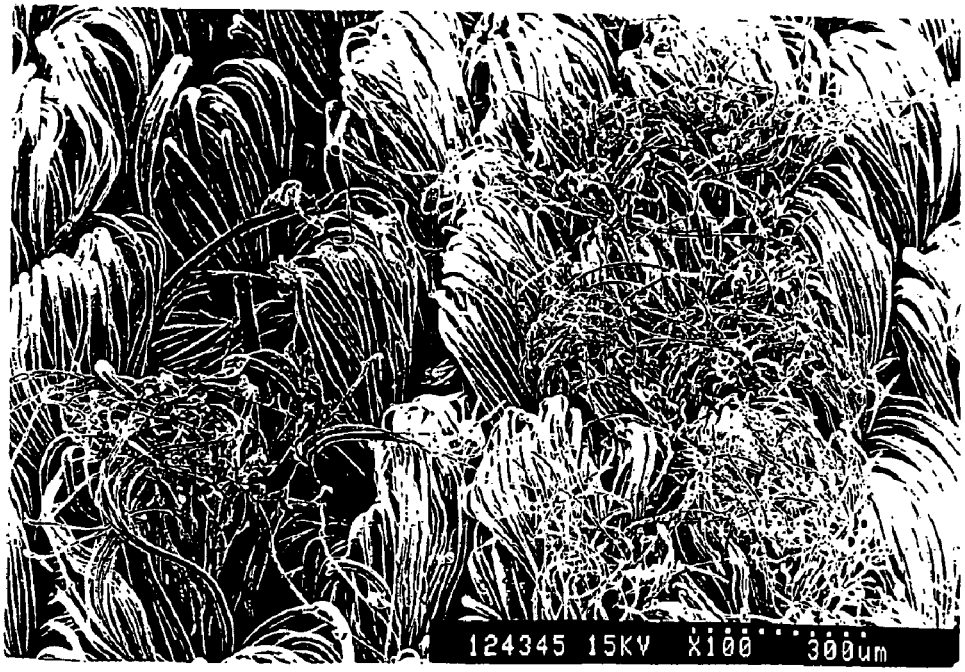
Figure 4:
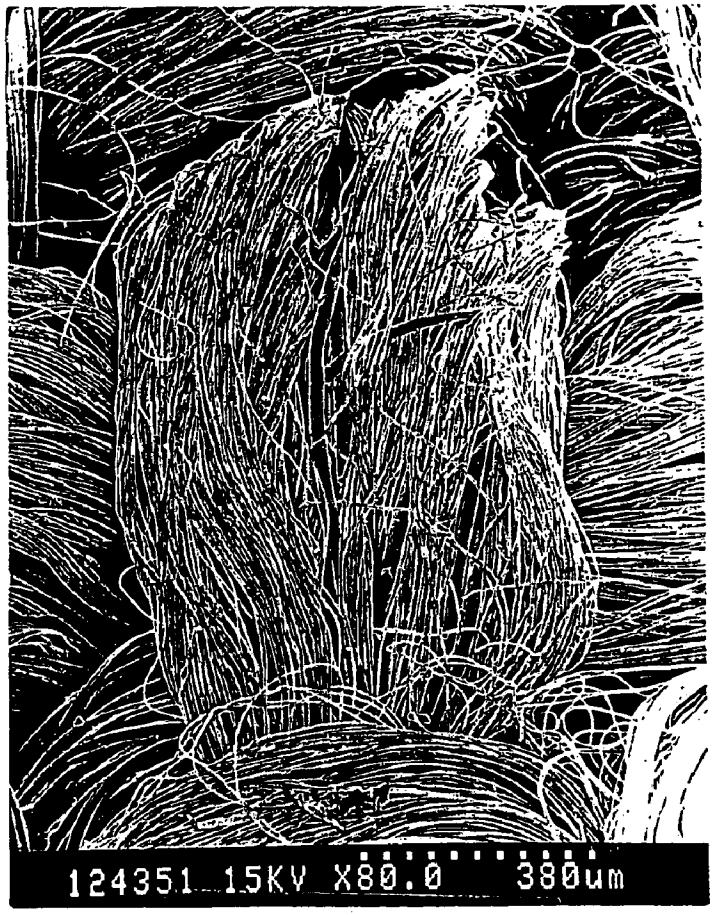
FIG. 4 is a partially enlarged photograph of the mat weave according to Example 4.
Figure 4:
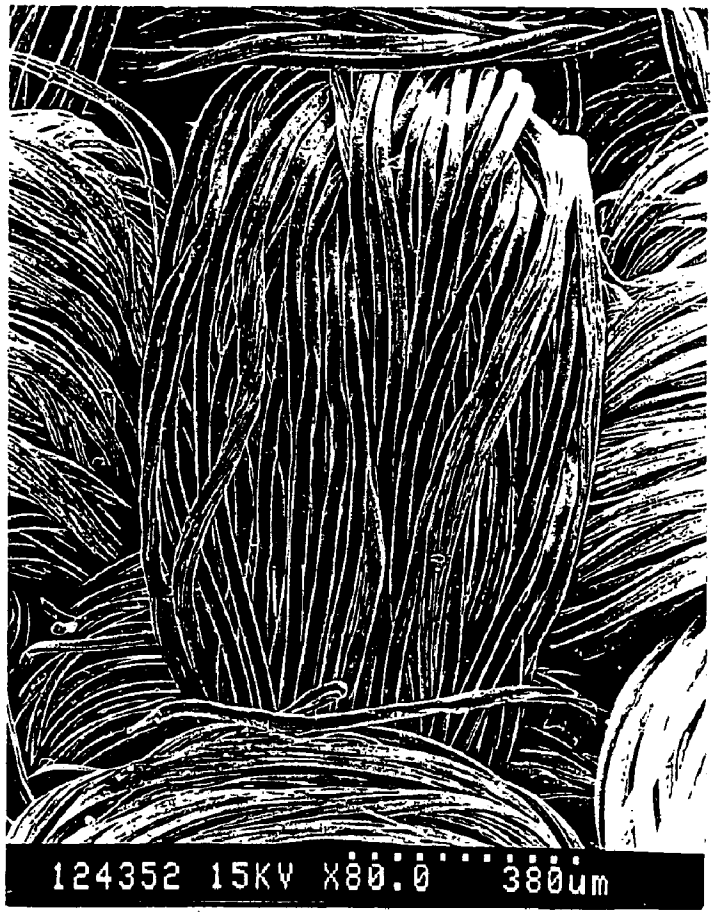

The denim-like clothing uses a woven or knitted fabric comprising ultrafine fibers or fibers capable of forming ultrafine fibers on its surface. Preferred ultrafine fibers or fibers capable of forming ultrafine fibers are separable conjugated fibers that can be divided by separation or island-in-sea type conjugated fibers containing plural segments (e.g., from 2 to 50 segments) of an island component.

The denim-like clothing mainly comprises a woven or knitted fabric comprising the ultrafine fibers or fibers capable of forming ultrafine fibers on its surface and preferably has a whitening index of Class 4 or lower, more preferably from Class 4 to Class 1, and typically preferably from Class 4 to Class 1, and typically preferably from Class 4 to Class 1–2, as expressed in grey scale for assessing change in color specified in JIS L0804. In this connection, Class 1–2 is a class located midway between Class 1 and Class 2. According to the present invention, multicore fibers are converted into ultrafine fibers or fibers capable of forming ultrafine fibers by acid treatment, and the degraded ultrafine fibers or fibers capable of forming ultrafine fibers are subjected to a physical or mechanical operation. By this procedure, the individual component units in the fibers are partially separated from each other. In the resulting conjugated fibers, each component is partially converted into fine fibers. The term "whitening index" as used in the present invention indicates a hue-difference in this state.

In the denim-like clothing, the ultrafine fibers or fibers capable of forming ultrafine fibers preferably have a roughness index of equal to or more than 3 micrometers as determined using a measuring machine, KES-FB4. The term "roughness index" as used herein means a surface roughness variation determined using a measuring machine, KES-FB4 (produced by KATO TECH). The roughness index is preferably equal to or more than 3 micrometers, more preferably from 3 to 20 micrometers and typically preferably from 4 to 15 micrometers.

The denim-like clothing typically preferably comprises one selected from woven or knitted fabrics of modified structures such as voile, mat USU (mat worsted), jacquard, corduroy, amunzen, cord and pile stitch. Alternatively, the woven or knitted fabric may comprise of a woven or knitted fabric having no roughness on its surface, such as taffeta, poplin, grey sheeting or SMOOTHNESS (interlock fabric). When this type of woven or knitted fabrics is sewn, the resulting woven or knitted fabric has projections and depressions (roughness) in stitches and return portions of the fabric, and the projections are partially whitened to yield a denim-like clothing.

The denim-like clothing preferably comprises 100% polyester conjugated filament yarns. However, the denim-like clothing may be a union fabric or union knitted fabric further comprising synthetic fiber filaments of, for example, other polyester fibers or of polyamide fibers or natural fiber yarns within a range not deteriorating the advantages of the present invention. For example, the constitutional woven or knitted fabric can comprise a polyester conjugated yarn as a weft and a conjugated yarn of, for example, a polyester as a warp. The latter conjugated yarn has different contraction properties.

In the denim-like clothing, the woven or knitted fabric comprises ultrafine fibers or fibers capable of forming ultrafine fibers at least on its surface. When island-in-sea type fibers are used as the fibers capable of forming ultrafine fibers, a matrix component of the fibers has been degraded. In such degraded multicore fibers, the constitutional polyester itself has a decreased average molecular weight and becomes brittle. The degraded polyester conjugated fibers each have an appearance that does not significantly change from that of the original fibers.

The polyester cloth for use in the present invention is generally dyed and sewn by conventional processes prior to or subsequent to the degradation treatment. In the sewn fabric, at least part of the polyester conjugated fibers in projections is converted into separated single filament yarns, for example, by a physical impact, and the resulting projections of the fabric become whitened by action of diffuse reflection. The resulting fabric exhibits worn-out feeling and exhibit stonewash-like feeling and semblance.

The term "fibers capable of forming ultrafine fibers" for use in the present invention means fibers that can form ultrafine fibers by flexing or rubbing and are island-in-sea type fibers containing a degraded matrix component (sea component) or multicore fibers that can be divided by separation. The term "multicore fibers" as used herein means fibers containing a core component and a matrix component, the core component and the matrix component comprise different polymers having weak bonding force with each other, and the core component is exposed to a surface of the fibers and can be divided or separated from the matrix component without destruction of the matrix component. Such multicore fibers include, for example, conjugated fibers and conjugated hollow fibers. The former conjugated fibers comprise a matrix component and plural segments of a core component, in which the plural segments of the core component in the form of wedges are radially arranged in the matrix component in cross section to thereby form a spoke- or radius-form cross section. The latter conjugated hollow fibers comprise plural core components, and the plural core components act as matrix components with respect to each other to thereby form a hollow cross section. The components that can be divided by separation include a polyamide and a polyester. The bonding strength between the two components can be controlled for example by copolymerization operation. For example, the bonding strength of a polyester with respect to a polyamide can be increased by the incorporation of a $—SO_3M$ group.

Ultrafine fibers or fibers capable of forming ultrafine fibers for use in the present invention are preferably ultrafine fibers having a fineness of less than or equal to 0.6 dtex or fibers capable of forming ultrafine fibers having a fineness of less than or equal to 0.6 dtex. More preferably, they are ultrafine fibers having a fineness of less than or equal to 0.3 dtex or fibers capable of forming ultrafine fibers having a fineness of less than or equal to 0.3 dtex.

Specifically, the fineness of the fibers capable of forming ultrafine fibers is preferably from 1 to 10 dtex and more preferably from 3 to 7 dtex. The fineness divided monofilaments of the separable conjugated fiber and the fineness of divided monofilaments of the island component of the island-in-sea type conjugated fiber is, as a mean, preferably from 0.01 to 0.6 dtex and more preferably from 0.01 to 0.3 dtex.

The denim-like clothing comprises such multicore fiber yarns. The yarns preferably have a fineness of from 80 to 650 dtex.

The multicore fiber yarns may have a configuration of conventional twist yarn but should preferably have a configuration that exhibits rough feeling, such as of a slub thread, thick and thin yarn, thick yarn, interlacing yarn, or textured yarn. The use of such a yarn of a configuration exhibiting rough feeling can advantageously attain the feeling of a natural fiber denim or of a stonewashed fabric by a separation treatment mentioned later.

The multicore fiber yarns can be used alone or in combination with the other yarns. For example, the multicore fiber yarn may be a conjugated yarn comprising a multicore fiber and another fiber, such as a core-and-sheathe type conjugated yarn. The core-and-sheathe type conjugated yarn comprises the multicore fiber for use in the present invention as a sheathe component and another high contraction polyester fiber as a core component.

A typical material for use in the production of the denim-like clothing is a multicore fiber containing a multicore component and a matrix component. In this fiber, the multicore component is a polyethylene terephthalate polymer, and the matrix component is, for example, a polyester containing from 1.5% to 15% by mole of a monomer containing a —$SO_3M$ group, where M is a hydrogen atom, an alkaline metal or an alkaline-earth metal, in which the matrix component has been treated with an acid. Alternatively, the multicore fibers for use in the production are preferably multicore fibers each comprising different components, which different components act as matrix components with respect to each other, can be separated and are a polyamide and a polyester.

Preferable multicore fibers are separable conjugated fibers that can be divided into at least two, preferably four or more, and more preferably five or more segments or island-in-sea type conjugated fibers containing plural segments (e.g., from 2 to 50 segments) of an island component.

In the polyester-based multicore fiber, the matrix component is preferably a polyester that can be degraded by action of an acid, and the core component is preferably a polymer that is resistant to such acid-induced degradation. Such polyesters that can be degraded by action of an acid are preferably polyesters that can be degraded by treatment with an acidic solution as mentioned below and are polyester copolymers (copolyesters) each containing, for example, from 1.5% to 15% by mole and preferably from 1.5% to 13% by mole of a —$SO_3M$ group, where M is a hydrogen atom or a metal such as an alkaline metal or an alkaline-earth metal. The content of the —$SO_3M$ group in the polyester copolymers is more preferably from 3% to 12% by mole and typically preferably from 6% to 10% by mole. This component can be selectively highly dyed with a cationic dye and is degraded by action of an acid. Accordingly, the dyed component is selectively removed by flexing or rubbing to thereby enhance whitening of the cloth. If the content of the —$SO_3M$ group is less than 1.5% by mole, the dyeing affinity of the resulting fiber with a cationic dye may be decreased, and a sufficiently intense color cannot be significantly obtained. If the content exceeds 15% by mole, the resulting fiber may have deteriorated physical properties and yarn-making property.

These copolymers are prepared, for example, by copolymerization of a sulfo-group containing monomer such as allylsulfonic acid and are generally called as cation-dyeable polyesters. Specifically, such copolymers include polyethylene terephthalate, polypropylene terephthalate and polybutylene terephthalate each containing preferably from 3% to 7% by mole of sodium 5-sulfoisophthalate as a comonomer component.

Preferred polymers resistant to acid-induced degradation for use in the present invention are polyesters and polyamides such as nylon 6 and nylon 66, of which polyesters are typically preferred. Such polyesters include, for example, polyethylene terephthalate, polypropylene terephthalate, polybutylene terephthalate, and copolymers containing any of these polyester polymers and a third component.

When the invented denim-like clothing is subjected to degradation treatment with an acid after sewing, a sewing thread and lining cloth preferably comprise a polymer resistant to acid-induced degradation. Such polymers include, for example, polyesters and polyamides such as nylon 6 and nylon 66, of which polyesters are typically preferred.

When a natural-fiber-conjugated interlining is used as an interlining, the interlining easily undergoes acid-induced degradation, and the interlining and lining are therefore preferably sewn to a cloth after the oxidation treatment.

The denim-like clothing and the production method thereof will be illustrated in detail below. The denim-like clothing can be produced, for example, by subjecting a multicore fiber fabric comprising a $SO_3M$-group-containing polyester as a matrix component to treatment with an acidic solution with pH of from 1.4 to 4 at temperatures of from 100° C. to 140° C. This procedure can be performed prior to or subsequent to sewing. The pH of the treatment solution is more preferably from 2 to 3. If the pH is excessively high or if the treatment temperature is excessively low, the matrix component cannot be significantly degraded.

This treatment with an acidic solution at high temperatures reduces the average molecular weight of the $SO_3M$-group-containing polyester to thereby degrade the polyester. Such acids include, but are not limited to, hydrochloric acid, sulfuric acid, nitric acid, phosphoric acid, oxalic acid, malic acid and maleic acid, of which malic acid, maleic acid and other organic acids are preferred. Processes for treatment include, for example, a process in which the polyester cloth is immersed in the acidic solution, and a process in which the acidic solution is sprayed onto the polyester cloth and the polyester cloth is then held at a predetermined temperature using, for example, a high-pressure steamer. The acidic solution may further comprise other components such as surfactants within ranges not deteriorating the advantages of the present invention.

In general, polyester fibers can be converted into ultrafine fibers by alkali treatment. However, it is not preferable to subject the polyester cloth for use in the present invention to alkali treatment. If the polyester cloth is subjected to alkali treatment, the polyester cloth losses in weight and becomes excessively thin or fine. In extreme cases, the constitutional yarn of the polyester cloth is fully separated in this step, and the resulting clothing cannot significantly have a partially whitened denim-like texture. According to the present invention, therefore, the degraded multicore fiber is preferably partially divided into separated filament yarns by flexing or rubbing without alkali treatment.

According to the invention, the fabric can be dyed by conventional techniques using, for example, a disperse dye and/or a cationic dye prior to or subsequent to the treatment with the acidic solution. The dyeing operation can also be performed on the polyester cloth after sewing operation.

When the polyester cloth is dyed, it is preferably dyed at temperatures from 100° C. to 145° C. and more preferably temperatures from 110° C. to 130° C. using, for example, a jet dyeing machine. If the sewn fabric is dyed, it is preferably dyed at temperatures from 80° C. to 140° C. and more preferably temperatures from 90° C. to 110° C. using, for example, a washer or drum dyeing machine. In this procedure, a carrier, antistatic agent and/or softening agent can be used in combination with the dye according to necessity.

The above-prepared polyester cloth is sewn and is then subjected to physical operation such as rubbing or stonewashing. By this procedure, the degraded polyester conjugated fiber is partially divided into separated single filament yarns. The sewn fabric has depressions and projections such as stitches or seams, and the physical action naturally acts higher upon the projections. Consequently, part of the constitutional fibers in the projections are mainly divided into separated single filament yarns, and the resulting clothing becomes a denim-like clothing exhibiting the feeling or semblance of a natural fiber denim or of a stonewashed fabric. This is probably because the multicore fibers are partially divided into separated single filament yarns, and the divided fibers in the projections of the sewn fabric appear white by diffused reflection to thereby exhibit worn-out feeling.

As a process for dividing constitutional fibers in the projections in the cloth, preferred is a process in which a physical impact is applied on multicore fibers to thereby convert the same into separated single filament yarns. Specifically, such processes include a stonewashing process using a washer, in which the sewn fabric is mechanically washed in a liquid or a process in which the sewn fabric is subjected to forced treatment using a washing machine.

The constitutional fibers can be further divided into separated single filament yarns by imparting rubbing or physical impact through repeated wearing or repeated washing.

When the sewn fabric is treated in a liquid, the liquid may further comprise an antistatic agent and/or a softening agent. Additionally, water-repelling, water-absorption, and other functions can be imparted to the fabric according to necessity.

The fibers of the sewn fabric subjected to a predetermined physical treatment can be further divided into separated single filament yarns by repeated wearing or repeated washing, and the resulting fabric exhibits higher jeans-like feeling.

The denim-like clothing can be successfully exhibit worn-out feeling even though it comprises synthetic fibers. Accordingly, the denim-like clothing is promising in new applications in the field of sewn fabrics like a natural fiber denim, such as trousers (jeans).

EXAMPLES

The present invention will be illustrated in further detail with reference to several examples. The roughness index and whitening index were determined by the following methods.

Roughness Index

A sample 20 cm times 20 cm in size was subjected to measurement using a measuring machine (produced by KATO TECH, under the trade name of KES-FB4) under standard measuring conditions (KENS (roughness): 2×5, tensile speed: 0.1 cm/second, initial tensile force: 20 gf/cm, roughness pressure: 10 gf).

Whitening Index

A hue-difference between before and after the formation of ultrafine fibers was determined using the grey scale for assessing change in color specified in JIS L0804.

EXAMPLE 1

A circular section high contraction thread of a polyethylene terephthalate having a shrinkage percentage in boiling water of 20% and a size of 84 dtex-12 filaments was subjected to false-twist with a drawn yarn of a polyester island-in-sea type conjugated filament yarn (island component: polyethylene terephthalate, number of islands: 8, sea component: a polyethylene terephthalate copolymer containing 4% by mole of sodium 5-sulfoisophthalate, ratio of sea to island: 2:8) having a size of 84 dtex-36 filaments. Two of the resulting false-twist yarn were subjected to secondary twist at a twist number of 800 T/M to thereby yield a warp.

Separately, a thick and thin yarn having a size of 167 dtex-48 filaments was subjected to false twist and secondary twist at a twist number of 800 T/M to thereby yield a weft. The prepared warp and weft were woven into a HOSOKORU woven fabric (pin-wale corduroy) having a width of 198.5 cm and a weaving density of 145×67 yarns per inch.

The HOSOKORU woven fabric (pin-wale corduroy) was then subjected to relaxation and scouring at 98° C. using a device for scouring with open width, was dried at 120° C. and was subjected to intermediate set at 160° C. for 30 seconds. The resulting fabric was subjected to acid treatment in a jet dyeing machine using 1 g/L of a degradation agent (maleic acid produced by Takeda Chemical Industries, Ltd. under the trade name of "Maleteed CM")at 125° C. for 30 minutes at a bath ratio of 1:25. The treatment solution had pH of 2.5. Subsequently, the treated fabric was dyed to deep blue in a jet dyeing machine using a disperse dye at 125° C. for 45 minutes. The dyed fabric was dried at 90° C., was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch.

The above-prepared polyester cloth was sewn into a jacket and was then subjected to stonewash treatment, in which 25 pieces of the jacket were treated with 100 kg of walnut balls in 700 L of water containing 1 g/L of a softening agent (produced by Takamatsu Oil & Fat Co., Ltd., under the trade name of "Colomodel T-105") in a washer at 80° C. for 40 minutes. The walnut balls each contained a walnut in a 3-cm synthetic rubber. The stonewashed jacket was then dried and was subjected to assessment. The conditions in the procedure and results in the assessment are shown in Tables 1 and 2.

EXAMPLE 2

A false-twist textured yarn (one-heater woolly nylon) having a size of 84 dtex-36 filaments was subjected to secondary twist at a twist number of 1200 T/M to thereby yield a warp.

Separately, a circular section high contraction thread of a polyethylene terephthalate having a shrinkage percentage in boiling water of 20% and a size of 33 dtex-6 filaments was subjected to conjugate twist with the island-in-sea type conjugated filament yarn used in Example 1 to thereby yield yarns. Two of the resulting yarns were further subjected to combined twist at a twist number of 800 T/M to thereby yield a weft. The above-prepared warp and weft were woven into a weft splush fabric having a width of 200 cm and a weaving density of 125×80 yarns per inch.

The prepared woven fabric was then processed under the same conditions as in Example 1 to thereby yield a finishing-set cloth having a width of 146 cm and a finishing density of 171×105 yarns per inch. The resulting cloth was sewn into a jacket, and the jacket was treated and assessed under the same condition as in Example 1. The conditions and results are shown in Tables 1 and 2.

EXAMPLE 3

The circular section high contraction thread and the island-in-sea type conjugated filament yarn used in Example 1 were combined in the ratio of 1:1 and woven to yield yarns, and two of the resulting yarns were subjected to secondary twist at a twist number of 800 T/M to thereby yield a warp.

Separately, the thick and thin yarn used in Example 1 was subjected to false-twist and secondary twist at a twist number of 200 T/M to thereby yield a weft. The above-prepared warp and weft were woven into a corduroy woven fabric having a width of 198.5 cm and a weaving density of 145×67 yarns per inch.

The prepared woven fabric was then processed under the same conditions as in Example 1 to thereby yield a finishing-set cloth having a width of 150 cm and a finishing density of 192×90 yarns per inch. The resulting cloth was sewn into a jacket, and the jacket was treated and assessed under the same condition as in Example 1. The conditions and results are shown in Tables 1 and 2.

EXAMPLE 4

A drawn yarn of a polyester island-in-sea type conjugated filament yarn (island component: polyethylene terephthalate, number of islands: 36, sea component: a polyethylene terephthalate copolymer containing 4% by mole of sodium 5-sulfoisophthalate, ratio of sea to island: 25:75) having a size of 270 dtex-40 filaments was subjected to false twist. Subsequently, a textured yarn using one heater and having a size of 167 dtex48 filaments was twisted with the false-twist yarn at a twist number of 400 T/M to yield a yarn, and two of the resulting yarn were further twisted at a twist number of 240 T/M to thereby yield a warp.

Separately, a polyester island-in-sea type conjugated filament yarn (island component: polyethylene terephthalate, number of islands: 36, sea component: a polyethylene terephthalate copolymer containing 4% by mole of sodium 5-sulfoisophthalate, ratio of sea to island: 25:75) having a size of 270 dtex-40 filaments was subjected to false twist, a textured yarn using one heater and having a size of 167 dtex-48 filaments was subjected to plied twist with the false-twist yarn at a twist number of 80 T/M. Two of the resulting yarn were further subjected to plied twist at a twist number of 80 T/M to thereby yield a weft. The warp and weft were woven to thereby yield a mat weave having a width of 174 cm and a weaving density of 104×67 yarns per inch.

The prepared woven fabric was then processed under the same conditions as in Example 1 to thereby yield a finishing-set cloth having a width of 152 cm and a finishing density of 120×74 yarns per inch. The resulting cloth was sewn into a jacket, and the jacket was treated and assessed under the same conditions as in Example 1. The conditions and results are shown in Tables 1 and 2.

EXAMPLE 5

A BURERIA (semi dull) textured yarn having a size of 110 dtex-24 filaments and the island-in-sea type conjugated filament yarn used in Example 1 were subjected to blended knitting in a ratio of 55.6:44.4 at 28 gauges at a drum diameter of 30 inches to thereby yield a reversible knitting having a width of 194 cm and a knitting density of 234 g/m.

Subsequently, the above-prepared reversible knitting was subjected to acid treatment in a jet dyeing machine using 1 g/L of a degradation agent (maleic acid, produced by Takeda Chemical Industries, Ltd. under the trade name of "Maleteed CM") at a bath ratio of 1:25, at 130° C. for 45 minutes. The treatment solution had pH of 2.5. Subsequently, the treated knitting was dyed to deep blue in a jet dyeing machine using a disperse dye at 130° C. for 45 minutes. The dyed fabric was dried at 90° C., was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 170° C. for 45 seconds to thereby yield a cloth having a width of 160 cm and a finishing density of 352 g/m.

The above-prepared polyester cloth was sewn into a jacket, was subjected to stonewashing and was assessed in the same manner as in Example 1. The conditions and results are shown in Tables 1 and 2.

EXAMPLE 6

The procedure of Example 1 was repeated to thereby yield a finishing-set cloth having a width of 150 cm and a finishing density of 192×90 yarns per inch. The prepared cloth was subjected to repeated wearing and repeated washing under the following conditions. The cloth was sewn into a jacket, was subjected to repeated wearing and was assessed in practical use. The conditions and results are shown in Tables 1 and 2.

Conditions for repeated wearing and repeated washing: A test was performed in pursuant to the method specified in JIS L1076C using an appearance-retention type tester, and 500 g of a sample was washed with 25 L of a 0.2% weak alkaline synthetic detergent solution at 40±2° C. using an automatic turnaround turbinated washing machine. In this washing procedure, the sample was subjected to washing for 5 minutes and was then subjected to rinsing for 2 minutes twice. The washing procedure was repeated ten times.

EXAMPLE 7

The procedure of Example 1 was repeated to thereby yield a dyed and dried cloth. The prepared cloth was subjected to treatment at 90° C. for 45 minutes with 1 g/L of a softening agent (produced by Takamatsu Oil & Fat Co., Ltd., under the trade name of "Colomodel T-105") in an airflow processor (produced by Nissen Co., Ltd., type MT) at a cloth speed of 350 m/minute, at a number of contact between the cloth and nozzle of 3.5 per minute and at a bath ratio of 1:5 at 90° C. for 45 minutes. The treated cloth was then immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch. The prepared cloth was then assessed. The conditions and results are shown in Tables 1 and 2.

EXAMPLE 8

The procedure of Example 1 was repeated to thereby yield an acid-treated cloth. The resulting cloth was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch. The prepared cloth was sewn into a jacket. The jacket was then subjected to stonewashing and dyeing, in which 25 pieces of the jacket were treated with 100 kg, of walnut balls in 2000 L of water containing a cationic dye in a washer at 98° C. for 40 minutes. The walnut balls each contained a walnut in a 3-cm synthetic rubber. In this procedure, the sea component alone of the island-in-sea type conjugated filament yarn was dyed to deep blue. The resulting jacket was then treated with 1 g/L of a softening agent (produced by Takamatsu Oil & Fat Co., Ltd., under the trade name of "Colomodel T-105"), was dried in a tumbling barrel and was assessed. The conditions and results are shown in Tables 1 and 2.

EXAMPLE 9

The procedure of Example 1 was repeated to thereby yield an acid-treated cloth. The resulting cloth was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch. The prepared cloth was sewn into a jacket and was then subjected to dyeing, in which 25 pieces of the jacket were treated with 2000 L of water containing a cationic dye in a washer at 98° C. for 40 minutes. In this procedure, the sea component alone of the island-in-sea type conjugated filament yarn was dyed to deep blue. The resulting jacket was then treated with 1 g/L of a softening agent (produced by Takamatsu Oil & Fat Co., Ltd., under the trade name of "Colomodel T-105"), was dried in a tumbling barrel, was subjected to repeated wearing and repeated washing under the same conditions as in Example 6 and was then assessed. The conditions and results are shown in Tables 1 and 2.

EXAMPLE 10

A circular section high contraction thread of a polyethylene terephthalate having a shrinkage percentage in boiling water of 20% and a size of 84 dtex-12 filaments was subjected to false twist with a drawn yarn of a nylon/polyester separable fiber capable of forming ultrafine fibers (core: a nylon being arranged in the form of radial eight wedges, sheathe: a polyester in the form of a spoke or radius, ratio of core to sheathe: 85:15, this yarn can be divided into 8 yarns) having a size of 56 dtex-18 filament. Two of the resulting false twist yarn were subjected to secondary twist at a twist number of 800 T/M to thereby yield a warp. Separately, a thick and thin yarn having a size of 167 dtex-48 filaments was subjected to false twist and secondary twist at a twist number of 800 T/M to thereby yield a weft. The prepared warp and weft were woven into a HOSOKORU woven fabric (pin-wale corduroy) having a width of 198.5 cm and a weaving density of 145×67 yarns per inch.

The HOSOKORU woven fabric (pin-wale corduroy) was then subjected to relaxation and scouring at 98° C. using a device for scouring with open width, was dried at 120° C. and was subjected to intermediate set at 160° C. for 30 seconds. Subsequently, the fabric was dyed in a jet dyeing machine using a disperse dye at 125° C. for 45 minutes to deep blue. The dyed fabric was dried at 90° C., was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch.

The resulting cloth obtained through the above process without acid treatment was subjected to repeated wearing and repeated washing under the same conditions as in Example 6. The cloth was sewn into a jacket, and the jacket was subjected to repeated wearing and was assessed in practical use. The conditions and results are shown in Tables 1 and 2.

EXAMPLE 11

A circular section high contraction thread of a polyethylene terephthalate having a shrinkage percentage in boiling water of 20% and a size of 84 dtex-12 filaments was subjected to false twist with a drawn yarn of a polyester separable fiber capable of forming ultrafine fibers (core: a polyethylene terephthalate copolymer containing 4% by mole of sodium 5-sulfoisophthalate and being arranged in the form of radial eight wedges, sheathe: polyethylene terephthalate in the form of a spoke or radius, ratio of core to sheathe: 85:15, and this yarn can be divided into 8 filaments) having a size of 56 dtex-18 filaments. Two of the resulting false twist yarn were subjected to secondary twist at a twist number of 800 T/M to thereby yield a warp. Separately, a thick and thin yarn having a size of 167 dtex-48 filaments was subjected to false twist and secondary twist at a twist number of 800 T/M to thereby yield a weft. The prepared warp and weft were woven into a HOSOKORU woven fabric (pin-wale corduroy) having a width of 198.5 cm at a weaving density of 145×67 yarns per inch.

The prepared cloth was then processed under the same conditions as in Example 1 to thereby yield a finishing-set cloth having a width of 150 cm and a finishing density of 192×90 yarns per inch. The resulting cloth was sewn into a jacket, and the jacket was treated and assessed under the same condition as in Example 1. The conditions and results are shown in Tables 1 and 2.

EXAMPLE 12

A circular section high contraction thread of a polyethylene terephthalate having a shrinkage percentage in boiling water of 20% and a size of 84 dtex-12 filaments was subjected to false-twist with a drawn yarn of a polyester island-in-sea type conjugated filament yarn (island component: polyethylene terephthalate, number of islands: 70, sea component: a polyethylene terephthalate copolymer containing 4% by mole of sodium 5-sulfoisophthalate, ratio of sea to island: 13:87). Two of the resulting false-twist yarn were subjected to secondary twist at a twist number of 800 T/M to thereby yield a warp.

Separately, a thick and thin yarn having a size of 167 dtex-48 filaments was subjected to false twist and secondary twist at a twist number of 800 T/M to thereby yield a weft. The prepared warp and weft were woven into a HOSOKORU woven fabric (pin-wale corduroy) having a width of 198.5 cm and a weaving density of 145×67 yarns per inch.

The prepared cloth was then processed under the same conditions as in Example 1 to thereby yield a finishing-set cloth having a width of 150 cm and a finishing density of 192×90 yarns per inch. The resulting cloth was sewn into a jacket, and the jacket was treated and assessed under the same condition as in Example 1. The conditions and results are shown in Tables 1 and 2.

EXAMPLE 13

A semi dull circular section textured yarn having a size of 56 dtex-18 filaments was prepared as a warp.

Separately, a drawn yarn of a polyester island-in-sea type conjugated filament yarn (island component: polyethylene terephthalate, number of islands: 8, sea component: a polyethylene terephthalate copolymer containing 4% by mole of sodium 5-sulfoisophthalate, ratio of sea to island: 2:8) having a size of 84 dtex-36 filaments was prepared as a weft. The prepared warp and weft were woven into a plain weave fabric having a width of 164.0 cm and a weaving density of 103×79 yarns per inch.

The prepared woven fabric was then processed under the same conditions as in Example 1 to thereby yield a finishing-set cloth having a width of 153 cm and a finishing density of 110×80 yarns per inch. The resulting cloth was sewn into a jacket, and the jacket was treated and assessed under the same condition as in Example 1. The conditions and results are shown in Tables 1 and 2.

EXAMPLE 14

A woven fabric was prepared in the same manner as in Example 1, was subjected to relaxation and scouring at 98° C. using a device for scouring with open width, was dried at 120° C. and was subjected to intermediate set at 160° C. for 30 seconds. The resulting fabric was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch. The prepared cloth was sewn into a jacket using a polyester sewing thread, interlining and plain weave lining. The jacket was subjected to acid treatment in a high-pressure washer using 1 g/L of a degradation agent (maleic acid produced by Takeda Chemical Industries, Ltd. under the trade name of "Maleteed CM") at a bath ratio of 1:25 at 125° C. for 30 minutes. The treatment solution had pH of 2.5. The jacket was then subjected to stonewashing and dyeing, in which 25 pieces of the jacket were treated with 100 kg of walnut balls in 2000 L of water containing a cationic dye in an atmospheric-pressure washer at 98° C. for 40 minutes. The walnut balls each contained a walnut in a 3-cm synthetic rubber. In this procedure, the sea component alone of the island-in-sea type conjugated filament yarn was dyed to deep blue. The resulting jacket was then treated with 1 g/L of a softening agent (produced by Takamatsu Oil & Fat Co., Ltd., under the trade name of "Colomodel T-105"), was dried in a tumbling barrel and was assessed. The conditions and results are shown in Tables 1 and 2.

COMPARATIVE EXAMPLE 1

A woven fabric was prepared in the same manner as in Example 1, was subjected to relaxation and scouring at 98° C. using a device for scouring with open width, was dried at 120° C. and was subjected to intermediate set at 160° C. for 30 seconds. The resulting fabric was subjected to acid treatment in a jet dyeing machine using 1 g/L of a degradation agent (maleic acid produced by Takeda Chemical Industries, Ltd. under the trade name of "Maleteed CM") at a bath ratio of 1:25, at 125° C. for 30 minutes. The treatment solution had pH of 2.5. The treated fabric was then subjected to weight reduction treatment in a jet dyeing machine using 1 g/L of NaOH at a bath ratio of 1:25 at 90° C. for 30 minutes. The fabric was then dyed in a jet dyeing machine using a disperse dye at 125° C. for 45 minutes to deep blue, was dried at 90° C., was immersed in an aqueous solution containing 5 g/L of an antistatic agent (produced by Nicca Chemical Co., Ltd., under the trade name of "Nicepole FL"), was squeezed using a mangle and was subjected to finishing set in a pin tenter at 120° C. for 45 seconds to thereby yield a cloth having a width of 150 cm and a finishing density of 192×90 yarns per inch. The prepared cloth was then sewn into a jacket, and the jacket was subjected to treatment and assessment under the same conditions as in Example 1. The conditions and results are shown in Tables 1 and 2. In this comparative example, the resulting jacket was fully whitened, and desired effect of partial whitening according to the present invention could not be obtained.

COMPARATIVE EXAMPLE 2

A woven fabric was obtained in the same manner as in Example 1, and the was subjected to the same procedure as in Example 10 to thereby yield a sewn jacket, and the jacket was subjected to treatment and assessment under the same conditions as in Example 1. The conditions and results are shown in Tables 1 and 2.

TABLE 1

| | Type of | Ultrafine fibers or ultrafine fibers formable fibers | | | Dyeing | Roughness | Whitening | | |
|---|---|---|---|---|---|---|---|---|---|
| | woven fabric* | Type | Fineness | Remarks | condition | index | index | Assessment | Remarks |
| Example 1 | corduroy | island-in-sea conjugated yarn | 0.29 dtex | | as in Table 3 | 13.236μ | 3 | good | |
| Example 2 | NANAKO | island-in-sea conjugated yarn | 0.29 dtex | | as in Table 3 | 5.018μ | 3–4 | good | |
| Example 3 | corduroy | island-in-sea conjugated yarn | 0.29 dtex | | as in Table 3 | 12.158μ | 3 | good | |
| Example 4 | NANAKO | island-in-sea conjugated yarn | 0.19 dtex | | as in Table 3 | 7.862μ | 3–4 | good | |
| Example 5 | reversible | island-in-sea conjugated yarn | 0.29 dtex | | as in Table 3 | 4.542μ | 2–3 | good | |
| Example 6 | corduroy | island-in-sea conjugated yarn | 0.29 dtex | | as in Table 3 | 13.236μ | 2–3 | good | |
| Example 7 | corduroy | island-in-sea conjugated yarn | 0.29 dtex | | as in Table 3 | 13.236μ | 3–4 | good | |
| Example 8 | corduroy | island-in-sea conjugated yarn | 0.29 dtex | | as in Table 3 | 13.236μ | 3 | good | |
| Example 9 | corduroy | island-in-sea conjugated yarn | 0.29 dtex | | as in Table 3 | 13.236μ | 2–3 | good | |
| Example 10 | corduroy | separable conjugated yarn | 0.22 dtex | | as in Table 3 | 13.236μ | 4 | good | |
| Example 11 | corduroy | separable conjugated yarn | 0.22 dtex | | as in Table 3 | 13.236μ | 3 | good | |
| Example 12 | corduroy | island-in-sea conjugated yarn | 0.09 dtex | | as in Table 3 | 13.236μ | 3 | good | |

TABLE 1-continued

| | Type of woven fabric* | Ultrafine fibers or ultrafine fibers formable fibers | | | Dyeing condition | Roughness index | Whitening index | Assessment | Remarks |
|---|---|---|---|---|---|---|---|---|---|
| | | Type | Fineness | Remarks | | | | | |
| Example 13 | plain weave fabric | island-in-sea conjugated yarn | 0.29 dtex | | as in Table 3 | 14.681$\mu$ | 3–4 | good | ** |
| Example 14 | corduroy | island-in-sea conjugated yarn | 0.29 dtex | | as in Table 3 | 14.256$\mu$ | 3–4 | good | ** |
| Com. Ex. 1 | corduroy | island-in-sea conjugated yarn | 0.23 dtex | | as in Table 3 | 12.896$\mu$ | 5 | poor | |
| Com. Ex. 2 | corduroy | island-in-sea conjugated yarn | (168 dtex) | | as in Table 3 | 13.638$\mu$ | 5 | poor | |

*Type of woven fabric:
Corduroy: a fabric comprising 2-mm pitch warp stripes formed by warp float combination weave texture (Examples 1 and 6 to 12, Comparative Examples 1 and 2).
NANAKO (weft plush): a woven fabric having a surface exhibiting rough feeling formed by texture combination of a warp and a weft (Example 2).
Corduroy: a fabric comprising 4-mm pitch warp stripes formed by warp float combination weave texture (Example 3).
NANAKO (mat weave): a woven fabric having a surface exhibiting rough feeling formed by an interlocked texture combination of a warp and a weft (Example 4).
Reversible: a fabric of 12-gauge reversible texture to form a pattern of dapples (Example 5).
**Remarks: the roughness index and whitening index were assessed in stitches or seams.

TABLE 2

| | Acid treatment | Alkali treatment | Dyeing | Sewing | Acid treatment | Stonewash | Dyeing | Dyeing and Stonewash | Repeated wearing and washing | Airflow |
|---|---|---|---|---|---|---|---|---|---|---|
| Example 1 | ○ | | ○ | ○ | | ○ | | | | |
| Example 2 | ○ | | ○ | ○ | | ○ | | | | |
| Example 3 | ○ | | ○ | ○ | | ○ | | | | |
| Example 4 | ○ | | ○ | ○ | | ○ | | | | |
| Example 5 | ○ | | ○ | ○ | | ○ | | | | |
| Example 6 | ○ | | ○ | ○ | | | | | ○ | |
| Example 7 | ○ | | ○ | | | | | | | ○ |
| Example 8 | ○ | | | ○ | | | | ○ | | |
| Example 9 | ○ | | | ○ | | | ○ | | ○ | |
| Example 10 | | | ○ | ○ | | | | | | |
| Example 11 | ○ | | ○ | ○ | | ○ | | | ○ | |
| Example 12 | ○ | | ○ | ○ | | ○ | | | | |
| Example 13 | ○ | | ○ | ○ | | ○ | | | | |
| Example 14 | | | | ○ | ○ | | | ○ | | |
| Com. Ex. 1 | ○ | ○ | ○ | ○ | | ○ | | | | |
| Com. Ex. 2 | | | ○ | ○ | | ○ | | | | |

When a symbol "○" is in a cell in the table, it means that a process in the column was performed. When the cell is blank, it means that the process in the column was not performed.

What is claimed is:

1. Clothing mainly comprising a polyethylene terephtalate woven or knitted fabric having a roughness index of equal to or more than 3 micrometers as determined with a measuring machine KES-FB4 and having a whitening index of less than or equal Class 4, the woven or knitted fabric comprising ultrafine fibers or multi-core fibers comprising a polyethylene terephthalate polymer as a multicore component on its surface, and the whitening index expressed in a grey scale for assessing change in color specified in (JIS L0804).

2. The clothing according to claim 1, wherein the whitening index is from Class 4 to Class 1 as expressed in the grey scale for assessing change in color specified in JIS L0804.

3. The clothing according to claim 2, wherein the whitening index is from Class 4 to Class 1–2 as expressed in the grey scale for assessing change in color specified in JIS L0804.

4. The clothing according to claim 1, wherein the roughness index is from 3 to 20 micrometers as determined with a measuring machine, KES-FP4.

5. The clothing according to claim 1, wherein roughness index is from 4 to 15 micrometers as determined with a measuring machine, KES-FB4.

6. The clothing according to claim 1, wherein the woven or knitted fabric is one selected from voile, mat USU (mat worsted), jacquard, corduroy, amunzen, cord and pile stitch.

7. The clothing according to claim 1, wherein the woven or knitted fabric is one selected from taffeta, poplin, grey sheeting, and SMOOTHNESS (interlock fabric).

8. The clothing according to claim 1, wherein the ultrafine fibers or fibers capable of forming ultrafine fibers are ultrafine fibers having a fineness of less than or equal to 0.6 dtex or fibers capable of forming ultrafine fibers having a fineness of less than or equal to 0.6 dtex.

9. The clothing according to claim 8, wherein the ultrafine fibers or fibers capable of forming ultrafine fibers are ultrafine fibers having a fineness of less than or equal to 0.3 dtex or fibers capable of forming ultrafine fibers having a fineness of less than or equal to 0.3 dtex.

10. The clothing according to claim 1, wherein the multicore fibers comprise, as a matrix component, a polyester containing from 1.5% to 15% by mole of a —$SO_3M$ group, where M is a hydrogen atom, an alkaline metal or an alkaline earth metal.

11. The clothing according to claim 10, wherein the matrix component is a polyester containing from 3% to 12% by mole of a —$SO_3M$ group, where M is a hydrogen atom, an alkaline metal or an alkaline earth metal.

12. The clothing according to claim 10, wherein the matrix component has been treated with an acid.

13. The clothing according to claim 1, wherein the multicore fibers are conjugated fibers comprising a matrix component and plural segments of a core component, and wherein the plural segments of the core component in the form of wedges are radically arranged in the matrix component in cross section to thereby form a spoke- or radius-form cross section.

14. The clothing according to claim 1, wherein the multicore fibers each comprise different components, and wherein the different components act as a matrix with respect to each other and can be separated from each other.

15. The clothing according to claim 14, wherein the different components are a polyamide and a polyester.

16. The clothing according to claim 1, wherein the clothing is dyed.

17. A method of producing a clothing comprising: flexing or rubbing a polyethylene terephthalate woven or knitted fabric comprising ultrafine fibers or multi-core fibers to thereby yield the clothing as claimed in claim 1.

18. The method of producing a clothing according to claim 17, wherein the flexing or rubbing is performed by stonewashing.

19. The method of producing a clothing according to claim 17, wherein the flexing or rubbing is performed in combination with a coloring operation.

20. The method of producing a clothing according to claim 17 further comprising, prior to the flexing or rubbing, treating with an acidic treatment solution having a pH of from 1.5 to 4 at a temperatures from 100° C. to 140° C. to thereby yield the clothing of claim 11.

* * * * *

UNITED STATES PATENT AND TRADEMARK OFFICE

CERTIFICATE OF CORRECTION

PATENT NO. : 6,752,840 B1
DATED : June 22, 2004
INVENTOR(S) : Onishi et al.

It is certified that error appears in the above-identified patent and that said Letters Patent is hereby corrected as shown below:

Column 3,
Line 6, after "fibers" please insert -- that contain an island component. Among them, typically preferred are separable conjugated fibers that can be divided into at least two, preferably four or more, and more preferably five or more segments or island-in-sea type conjugated fibers --.

Column 6,
Line 19, please change "1.4" to -- 1.5 --.

Signed and Sealed this

Twenty-fifth Day of January, 2005

JON W. DUDAS
*Director of the United States Patent and Trademark Office*